US009892719B2

(12) United States Patent
Wilk et al.

(10) Patent No.: US 9,892,719 B2
(45) Date of Patent: Feb. 13, 2018

(54) ENCLOSURE WITH WINDOWS FOR AUDIO EFFECTS AND GUITAR PEDALS

(71) Applicants: Seth J Wilk, Austin, TX (US); Leo Petrossian, Los Angeles, CA (US)

(72) Inventors: Seth J Wilk, Austin, TX (US); Leo Petrossian, Los Angeles, CA (US)

( * ) Notice: Subject to any disclaimer, the term of this patent is extended or adjusted under 35 U.S.C. 154(b) by 268 days.

(21) Appl. No.: 14/474,111

(22) Filed: Aug. 30, 2014

(65) Prior Publication Data

US 2016/0063976 A1 Mar. 3, 2016

(51) Int. Cl.
*G10H 1/34* (2006.01)
*G10H 1/055* (2006.01)

(52) U.S. Cl.
CPC ..... *G10H 1/348* (2013.01); *G10H 1/055* (2013.01); *G10H 2210/155* (2013.01); *G10H 2220/061* (2013.01)

(58) Field of Classification Search
CPC ..... G10H 1/02; G10H 1/348; G10H 1/055; G10H 2210/155; G10H 2220/061
USPC ..... 84/721, 746, 644
See application file for complete search history.

(56) References Cited

U.S. PATENT DOCUMENTS 2,230,836 A 2/1941 Hammond
2,982,819 A 5/1961 Meinema
3,045,522 A * 7/1962 Markowitz ..... G10H 1/0553 84/711
3,106,610 A 10/1963 Young
3,558,793 A * 1/1971 Nakada ..... G10H 1/0553 84/600
3,591,700 A * 7/1971 Neubauer ..... G10H 1/12 84/684
5,659,145 A * 8/1997 Weil ..... G10H 1/348 84/464 R
5,981,862 A * 11/1999 Geier, Jr. ..... G10H 1/348 84/721
8,131,003 B2 3/2012 Park
8,338,689 B1 * 12/2012 Beaty ..... G10H 1/0091 84/718
8,536,438 B2 * 9/2013 Goto ..... F16M 13/005 84/746
2006/0156903 A1 * 7/2006 Baird ..... G10H 1/348 84/453
2006/0278068 A1 * 12/2006 Nielsen ..... G10H 3/186 84/746

(Continued)

OTHER PUBLICATIONS http://www.diystompboxes.com/smfforum/index.php?topic=66840.0 (2008; "Valoosj" ; viewed online on Feb. 15, 2016).*

(Continued)

*Primary Examiner* — David Warren

(57) ABSTRACT

One embodiment of a rigid enclosure 101 with window or openings 102 so that an audio effect producing apparatus 130 approximately aligned to the openings is contained within and partially viewable to the operator. The enclosure is made of a rigid protective material and in an embodiment screens electromagnetic interference from the outside. The enclosure contains necessary hardware and additional openings to attach control electronics 114, knobs, switches 113, and pass-throughs for electrical signals such as power 112, input 110, and output 111 which can be located anywhere on the enclosure.

16 Claims, 11 Drawing Sheets

(56) References Cited

U.S. PATENT DOCUMENTS

| | | | | |
|---|---|---|---|---|
| 2007/0074623 | A1* | 4/2007 | Nakagawa | G10H 1/348 84/746 |
| 2010/0300273 | A1* | 12/2010 | Schon | G10H 3/187 84/746 |
| 2011/0061518 | A1* | 3/2011 | Iwamoto | G10H 1/348 84/746 |
| 2011/0271820 | A1* | 11/2011 | Cockerell | G10H 1/348 84/746 |
| 2014/0290469 | A1* | 10/2014 | Michaud | G10H 1/0091 84/741 |
| 2015/0161978 | A1* | 6/2015 | Packouz | G10H 1/40 84/746 |

OTHER PUBLICATIONS http://www.diystompboxes.com/smfforum/index.php?topic=36392.6660 ; hereinafter 6111; this archived web page was published in Aug. of 2008; the specific device used in this rejection is referred to as "6111 Infinity").* http://www.voxamps.com/fl4bt; hereinafter Flat 4; it is noted that the official manufacturer's product web page for this device is dated, using web archival data, Jun. 23, 2014, however this pedal appears in many earlier postings, e.g., YouTube, Amazon.com reviews, etc.).*

Danelectro, "Spring King DSR-1 Instructions." Accessed on Jul. 15, 2014. http://www.danelectro.com/download/DSR1_springking%20instructions.pdf.

'63 Fender® Tube Reverb, Accessed on Aug. 12, 2014. http://www.fender.com/series/vintage-reissue/63-fender-tube-reverb-lacquered-tweed-120v/.

The inventor, Seth J Wilk, demonstrated the art from this application at the South by Southwest Gear Expo symposium on Mar. 13-15 in 2014 which was less than one year from this submission of this application.

* cited by examiner

ENCLOSURE WITH WINDOWS FOR AUDIO EFFECTS AND GUITAR PEDALS

BACKGROUND

Prior Art

The following is a tabulation of some prior art that presently appears relevant:

U.S. PATENTS

| Pat. No. | Kind Code | Issue Date | Patentee |
|---|---|---|---|
| 2,230,836 | | 1941 Feb. 4 | Hammond |
| 2,982,819 | | 1961 May 2 | Meinema |
| 3,106,610 | | 1963 Oct. 8 | Young |
| 8,131,003 | B2 | 2012 Mar. 6 | Park |

NONPATENT LITERATURE DOCUMENTS

Danelectro, "Spring King DSR-1 Instructions." Accessed on Jul. 15, 2014. http://www.danelectro.com/download/DSR1_springking%20instructions.pdf '63 Fender® Tube Reverb, Accessed on Aug. 12, 2014. http://www.fendercom/series/vintage-reissue/63-fender-tube-reverb-lacquered-tweed-120v/

FIELD OF THE INVENTION

The present invention relates in general to an enclosure for an audio sound effect unit with an opening which enables the user to visually inspect the operation of an effect producing apparatus within.

BACKGROUND OF THE INVENTION

Musicians and recording professionals will often enhance or change the way an instrument sounds through the use of an audio effect such as distortion, delay, reverb, chorus, amplification, and others. An audio signal is input into an audio effect, is modified, and then output. Guitars are one subset of instruments and guitarists often use audio effects to change or amplify the original sound of the instrument. These audio effects can be housed in standalone enclosures which can easily be used by the musician and are known as effect units, guitar pedals, stompboxes, etc. The complete effect unit is made up of an enclosure which houses any combination of electrical circuitries, mechanical assemblies, and transducers to produce the desired change to the sound. The effect producing apparatus is the combination of parts within the enclosure that modify and affect the input signal.

The original sound is input into the effect unit, then is modified by the effect producing apparatus within the enclosure and is then output. The output modified sound can be electrically or wirelessly fed into another effect pedal, amplifier or directly into a recording interface through cords or wireless interfaces. These effect units are operated either by hand, by foot, through vocals or controlled remotely and can be placed on the floor, in or on an amplifier or in a rack of equipment near the musician.

In order to produce the audio sound effect, a number of different methods can be used including all electrical effects or mechanical systems coupled to electronic circuitry. These parts within the enclosure form an effect producing apparatus or unit which change the input signal. Any electrical part can be used including but not limited to transistors, resistors, capacitors, inductors, integrated circuits, filters, amplifiers, tubes, lights, transducers, etc. The electronics are usually hand wired or mounted to a printed circuit board (PCB). The mechanical systems can be any type of movement including rotation, vibration, reflection, plucking, damping, stretching, gear movement, and direct impact. An example of one of the most common effects employing a mechanical system is reverb which uses springs as a transmitter of sound vibrations. Mechanic electro transducers are used to introduce and pick up the sound that is transmitted and reflected through the springs. The mechanical assembly of springs and transducers is mounted in a casing or chassis which is designed to be easy to manufacture and is fully open on at least one side. A similar chassis can be used for other mechanical based effects. Common manufactures of these reverb tanks include MOD and Accutronics. A drawback of these systems is that they can not be used in a standalone manner and require additional control electronics. They are mounted within an amplifier, instrument or other enclosure that also contains the control electronics and hidden from view.

The chassis which houses the mechanical system is designed to be mounted within the final effect unit enclosure or guitar amplifier and often includes vibration isolating rubber grommets with holes for mounting. For mechanical systems, the chassis does not include all the electronics required for using the mechanical assembly as a complete standalone effect. For mechanical effects within a chassis, a drawback is that they require additional electronics such as amplifiers, gain stages, filters and even other electronic based effects so that proper signal levels and desired sound can be achieved. The reverb tank is one such mechanical system. Examples of such systems include U.S. Pat. No. 2,230,836 to Hammond, U.S. Pat. No. 2,982,819 to Meinema et al, U.S. Pat. No. 3,106,610 to Young and U.S. Pat. No. 8,131,003 to Park et al. All of these examples require additional control electronics to function as a complete effect producing apparatus and none have a fully protective enclosure.

Another drawback in the prior art is that the chassis, printed circuit board or hand wired components which make up the effect producing apparatus are subject to damage during transport as well as electromagnetic interference during operation. Electromagnetic interference is a large problem because it will contribute to the overall noise level and if it is too high will render the effect unusable. Because the effect producing apparatus is not fully enclosed in a metal box, it does not have the benefit of a Faraday cage surrounding it. Under the right circumstances, the outside signal from an amplifier to which the unit is connected can also be picked up and result in feedback and oscillations that are not wanted.

The prior art is to use an enclosure such as a metal box or a complete amplifier assembly so that the effect producing apparatus's components are fully enclosed and protected during operation and transportation. The enclosures are often made of a conductive material and ideally should be connected to the ground or earth ground of the effect although this is not always the case.

Windows or openings in the protective enclosure are therefore not obviously desirable due to the previous reasons. Examples of prior art, solid metal enclosures exist including those by companies such as Boss U.S., with products such as Boss FRV-1 '63 Fender Reverb Pedal, Electro-Harmonix with products such as the Big Muff Pi, Dunlop Manufacturing with products such as the Cry Baby or M×R line, and many others. In these examples and the current commercial products, there are holes cut in the enclosure but they are used for placement of connectors, direct electrical connection such as input and output, mounting screws, potentiometer mounting, etc. and they are substantially filled with these items. These holes do not allow the user to see within the enclosure.

In the prior art the musician is not able to visually inspect the operation of electronics or a mechanical assembly directly within the effect unit. The musician must rely on the audio sounds produced and knob settings for the electronics to determine how the effect is operating even though parts inside may be physically moving or blinking. The musician is also not able to visually see electrical components within the audio effect. One exception is that vacuum tubes are often left protruding from an opening in the effect because they are internally electrically screened and require heat dissipation. However, they are not protected during transportation or use unless they are protected by some other means such as a metal cage or brace. The vacuum tubes also completely fill the opening and do not enable the operator to view components of the effect producing apparatus within the effect unit. Examples of such systems are the ZVex Nano Head Tube Guitar Amp, the Hughes & Kettner TubeMeister 18 Tube Guitar Amp Head and a number of other amplifiers produced by manufacturers such as Fender or Marshall, etc. The tubes in these and other examples are not fully within the protective enclosure and although they are visable, they are not protected from damage. The additional circuitry in these examples is within a solid metal enclosure and is not directly visible to the operator unless the device is disassembled.

Not being able to visually inspect the electronics or mechanical unit that makes up the effect producing apparatus within the enclosure is a large drawback for many effects units. This is especially true for effects that use some type of mechanical means to change the audio sound. For instance, some genres of music such as surf guitar rely heavily on kicking a spring reverb system to produce a snapping and booming sound. In the current state of the art, the musician cannot actually see how the springs are mechanically moving to produce the desired effect. For electronic based effects, it is not possible to see indicator lights within the enclosure so lights such as LEDs are normally mounted on the outside of the enclosure. Mounting the LEDs to the outside of the enclosure require extra components such as bezels and make assembly more difficult and expensive.

SUMMARY OF THE INVENTION

A need exists for a multifunction enclosure which enables the musician to visually inspect an audio effect producing apparatus within.

In accordance with one embodiment, the present invention is an enclosure for an audio effect with one or more openings in the enclosure so that an audio effect producing apparatus contained within is visible to the user.

Advantages

Accordingly several advantages of one or more aspects are as follows: to provide a protective enclosure for an audio effect apparatus that allows a user to visually see components within the effect during operation or transport, to enable visual monitoring of a mechanical system within the enclosure producing an audio effect, to provide screening from unwanted electromagnetic interference, to provide light to illuminate the interior of the enclosure, to provide protection from outside materials such as dust or water, to provide for direct electrical connections to be made through the case without having to open the case, to provide pass-throughs for light, acoustics, mechanical actuation, and that can be easily manufactured and assembled. Other advantages of one or more aspects will be apparent from a consideration of the drawings and ensuing description.

DRAWINGS

Figures

DETAILED DESCRIPTION

Figure 1:
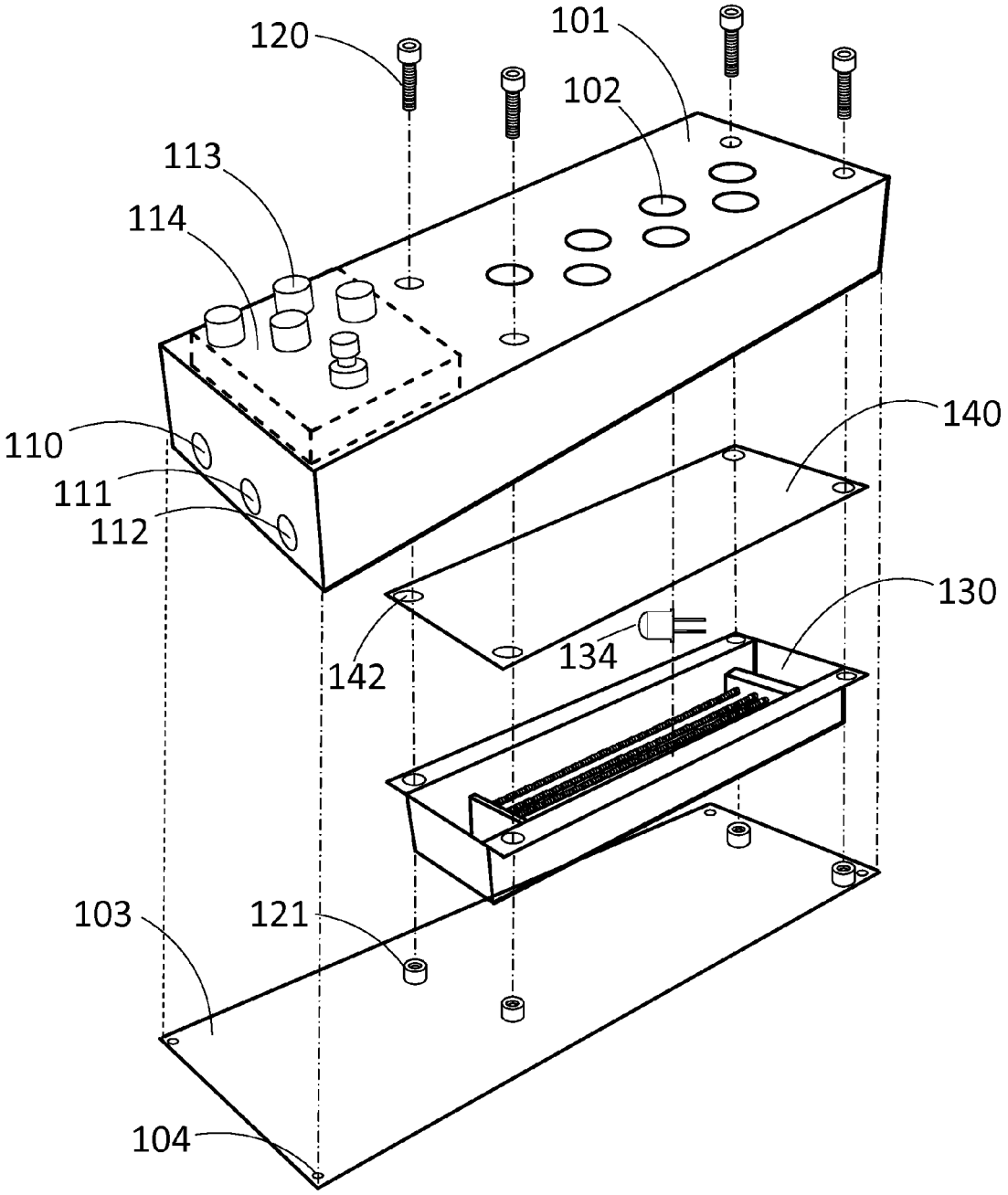
FIG. 1 is an exploded view of an embodiment of the invention.

FIG. 1 shows one embodiment in an exploded view. The embodiment has a rigid enclosure 101 containing one or more windows or openings 102 of any shape or size so that an effect producing apparatus 130 which could be a chassis, reverb tank, mechanical system, electrical circuit, pcb, hand wired electrical components, light, LED, etc. within the enclosure can be viewed by the operator. Windows 102 may be made small enough to help impede electromagnetic signals from entering the enclosure while still enabling the inner system to be visible. The enclosure can be any shape or size and is illustrated as a box as an example only. In an embodiment the enclosure is metal however it can consist of any material that is rigid such as wood, plastic, nylon, fibrous materials, etc. The material may be conductive to act as a Faraday cage and block unwanted electromagnetic interference from outside the enclosure or and could have electromagnetic screening material located on the inner or outer sides such as a metal screen, foil, metal sheet etc. The present invention may have window(s) 102 cut, drilled or routed out of the rigid material comprising the enclosure, left as holes in the original manufacturing process of the enclosure or use any other method of producing openings.

The enclosure contains the effect producing apparatus 130 and may contain additional items such as control electronics 114 within the enclosure for the complete operation of the audio effect. Electronics may include but are not limited to power distribution, amplification, filtering, other electric based audio effects such as distortion, delay, reverb, chorus, and any other possible audio electronics. The control electronics may be made up of any number of items and are not shown in detail but some examples include a PCB board, a fully contained electronics unit, an electronic assembly, or another effect producing apparatus, etc. and would be attached to the enclosure. Holes in the enclosure act as pass-throughs and allow knobs or switches 113 to be used to control the electronics within the rigid enclosure. Although not limited the following examples, the knobs may control potentiometers or pushbuttons.

A clear material 140 may be added to the window area, either inside or outside the enclosure, to protect the effect producing apparatus within but is not required. There are a number of possible materials, which may or may not be conductive which could be used to cover the window area including but not limited to glass, Plexiglas, plastic materials, etc. The manufacture of the enclosure may include slots so that the clear material is more easily inserted and held in place inside the enclosure. The clear material may contain holes 142 to facilitate assembly and attachment to the enclosure.

The enclosure allows for direct electrical connections to be made to items within without having to open the enclosure such as an input 110, output 111 and AC or DC power supply 112. The connections will most likely be jacks that are used for audio connections but could also be a battery holder, etc. Additionally, pass-throughs for light, acoustics and mechanical actuation, etc. may also be provided. The input connections and pass-throughs can be circular, square or any shape to accommodate the necessary jacks required to connect to the inner components and assemblies contained in the enclosure.

The enclosure allows for the mounting or containment of a light 134 such as a light bulb or LED within so that the effect producing apparatus can be viewed from the outside through the windows(s) 102. Light 134 can be mounted a number of ways including on the end of a wire, directly to a chassis 130, directly to enclosure 101 through means such as mechanical, bolts, screws, rivets, tape, adhesive, etc. The light enables easier viewing of the effect producing apparatus and can also serve as an indicator. For example, on and off or different colors of light can be used to show the status of the effect.

In the drawn embodiment, nuts 120 and bolts 121 are used to hold chassis 130 to enclosure 101 but other methods may include rivets, screws, springs, grommets, epoxy, string, wire, etc. Springs, grommets, string and other soft materials may be used to mechanically dampen and isolate the chassis from the enclosure and can either be used for direct attachment or between the chassis and enclosure. One example is rubber grommets but other soft materials could be used.

In the embodiment, a bottom cover plate 103 is used to fully encapsulate all items within enclosure 101 but it could be on any side or edge of the enclosure. The cover plate may contain holes 104 to enable it to be fastened to the other section(s) of the enclosure but could also be fastened with other removable means such as snaps, hinges, etc. In order to reduce noise, the entire enclosure and cover plate could be grounded to the ground of the effect producing apparatus and to the ground of the input signal as a Faraday cage.

To operate the effect unit, a user would be able to look through opening 102 and see the effect producing apparatus 130 within enclosure 101. Visual cues such as mechanical movement or lights within enclosure 101 would be viewable from the outside of the enclosure through opening 102. These windows are desirable during storage, transport and operation because they would allow the user to see the status of the effects producing apparatus within enclosure 101. In additional to a visual line of sight, during operation the windows can help let heat out of the effects unit or pass other signals into the effects unit.

Figure 2:
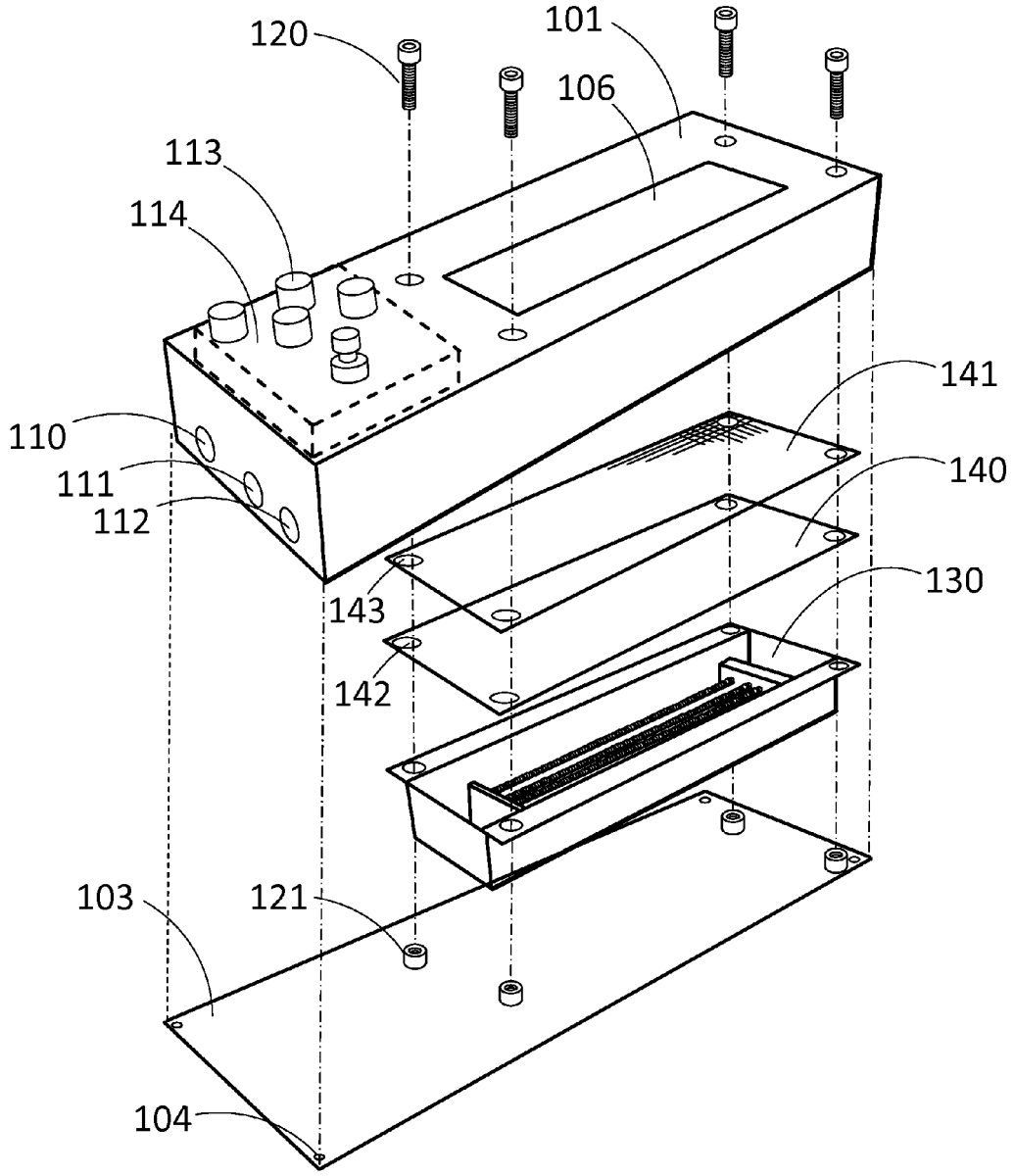
FIG. 2 is an exploded view of another embodiment of the invention showing a different window.

FIG. 2 shows an exploded illustration of an embodiment of the present invention where opening or window 106 is illustrated as a single rectangular shape instead of a circular opening or plurality of openings. The present invention is designed so that items within case or enclosure 101 such as a chassis 130, electronics or other effect producing apparatus can be viewed by the operator and as such the window can be any shape or size.

In an embodiment, a screen 141 can be added with or without clear material 140 to protect the items within the enclosure. Screen 141 may be a conductive material and can be grounded to help reduce unwanted noise from outside the enclosure thus acting as a Faraday cage. The screen may be an independent item or embedded within clear material 140. The screen may have holes 143 to facilitate assembly.

Figure 3:
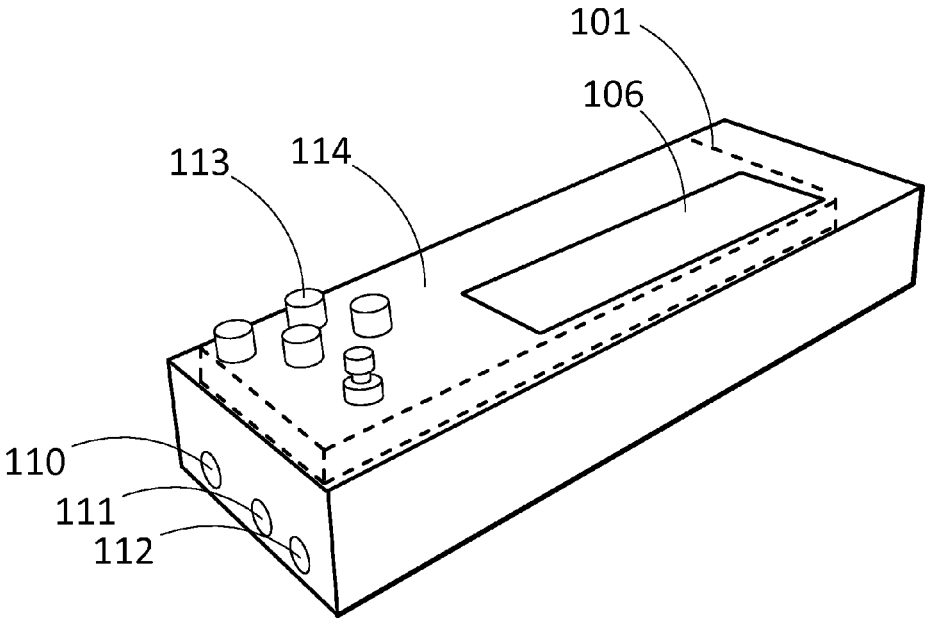
FIG. 3 is a perspective view of another embodiment of the invention.

FIG. 3 shows a perspective view of an embodiment of the present invention where opening or window 106 is illustrated as a single rectangular shape instead of circular opening(s). The present invention is designed so that items within case or enclosure 101 such as a chassis or electronics 114 can be viewed by the operator and as such the window can be any shape or size. This view shows electronics 114 as an example only aligned under the opening(s) but they could be replaced with any effect producing apparatus.

Figure 4:
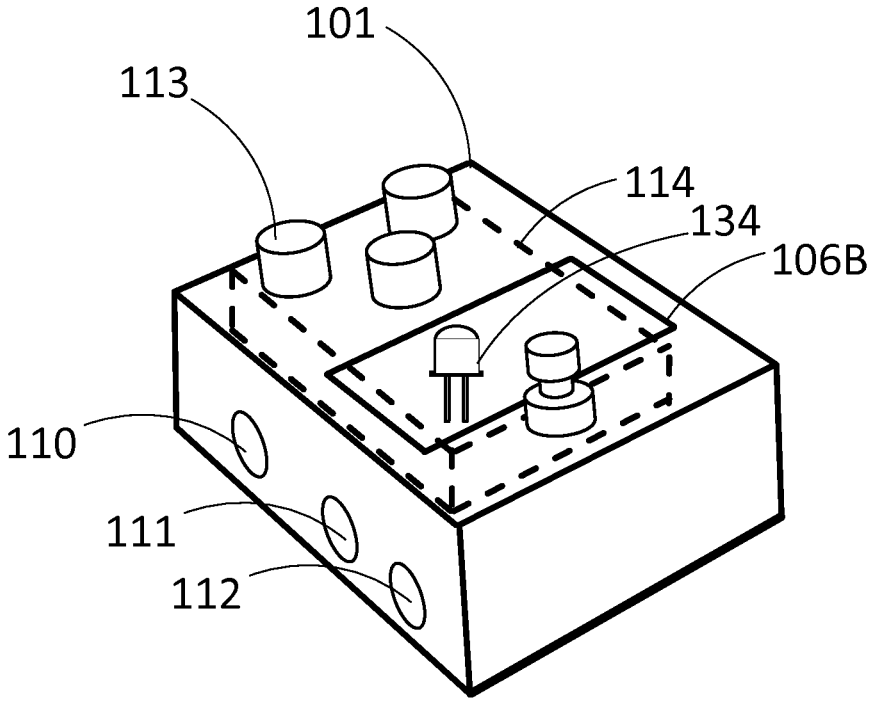
FIG. 4 is a perspective view of another embodiment of the invention.

FIG. 4 shows a perspective view of an embodiment of the present invention where opening or window 106B is illustrated as a single rectangular shape. The present invention is designed so that items within case or enclosure 101 such as an audio effect apparatus or electronics 114 can be viewed by the operator and as such the window can be any shape or size. This view shows electronics 114 as an example only aligned under the opening(s) but they could be replaced with any effect producing apparatus. The enclosure allows for mounting or containment of a light 134 such as a light bulb or LED within so that the effect producing apparatus can be viewed from the outside through the windows(s). Light 143 is optional. Although not shown, a protective screen, conductive screen or transparent material could be added inside or outside the opening and could be made of items including but not limited to glass, plexiglass, clear plastic, steel, mesh, screen, etc. Methods for attaching the material to the opening include but aren't limited to screws, rivets, adhesive, glue, epoxy, etc.

Figure 5:
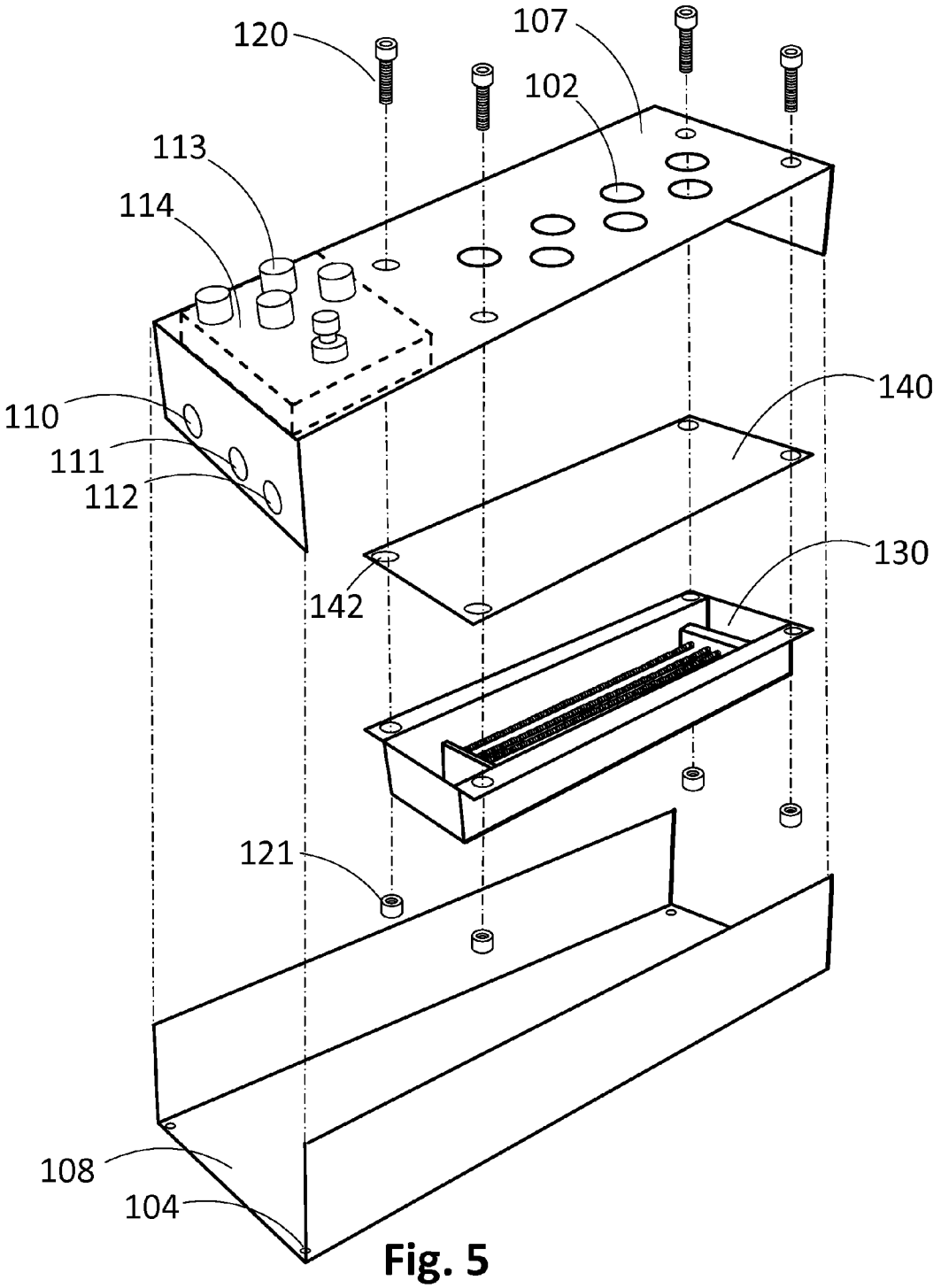
FIG. 5 shows an exploded view of an embodiment where the enclosure is made of two mostly c-shaped materials to facilitate easier assembly.

FIG. 5 shows an exploded illustration of an embodiment where the shape of the enclosure with a window(s) 102 of any shape or size is comprised of two mostly c-shaped rigid pieces, one top 107 and one bottom 108 that can be joined together to form a complete enclosure. The mostly c-shape pieces enable easier access during assembly. The embodiment contains one or more windows or openings 102 so that an effect producing apparatus 130 which could be a chassis, reverb tank, mechanical system, electrical circuit, etc. within the enclosure can be viewed by the operator.

Figure 6:
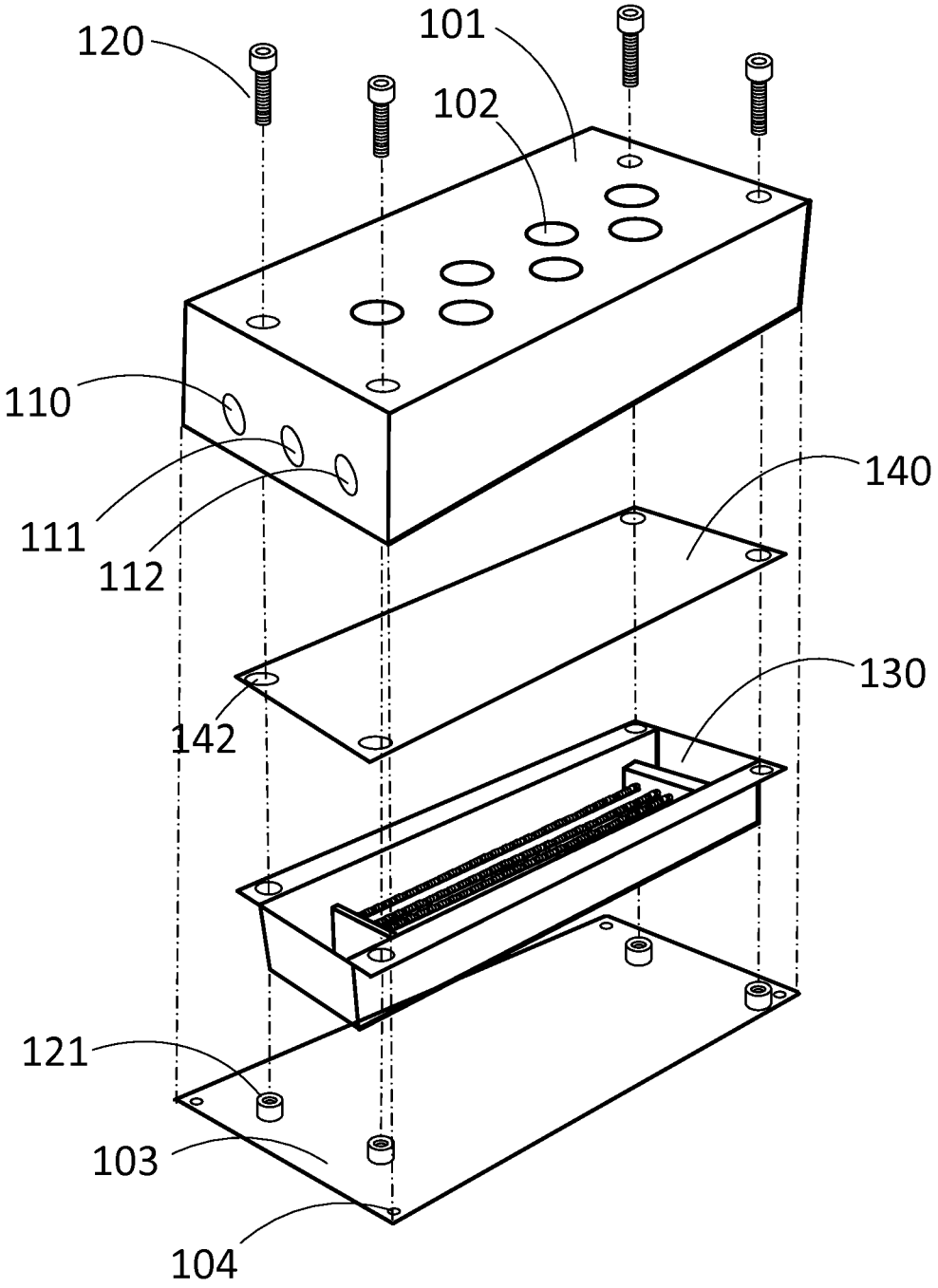
FIG. 6 shows an enclosure without control electronics in accordance with another embodiment.

FIG. 6 shows one embodiment in an exploded view that has a rigid enclosure 101 containing one or more windows or openings 102 of any shape or size so that an effect producing apparatus 130 which could be a chassis, reverb tank, mechanical system, etc. within the enclosure can be viewed by the operator. The enclosure 101 does not necessarily have to contain control electronics and could be completely mechanical within as illustrated by FIG. 6. A second box could be used to control the electronics. Although any mechanical effect producing apparatus is possible, a typical application would be to have different reverb tanks available, each housed in its own enclosure based on the present invention with another control electronics box. This would allow the user to choose a reverb tank and attach it to outside control electronics, thus reusing the same control electronics for different effects units. A reverb tank is only an example and any mechanical system could be used.

Figure 7:
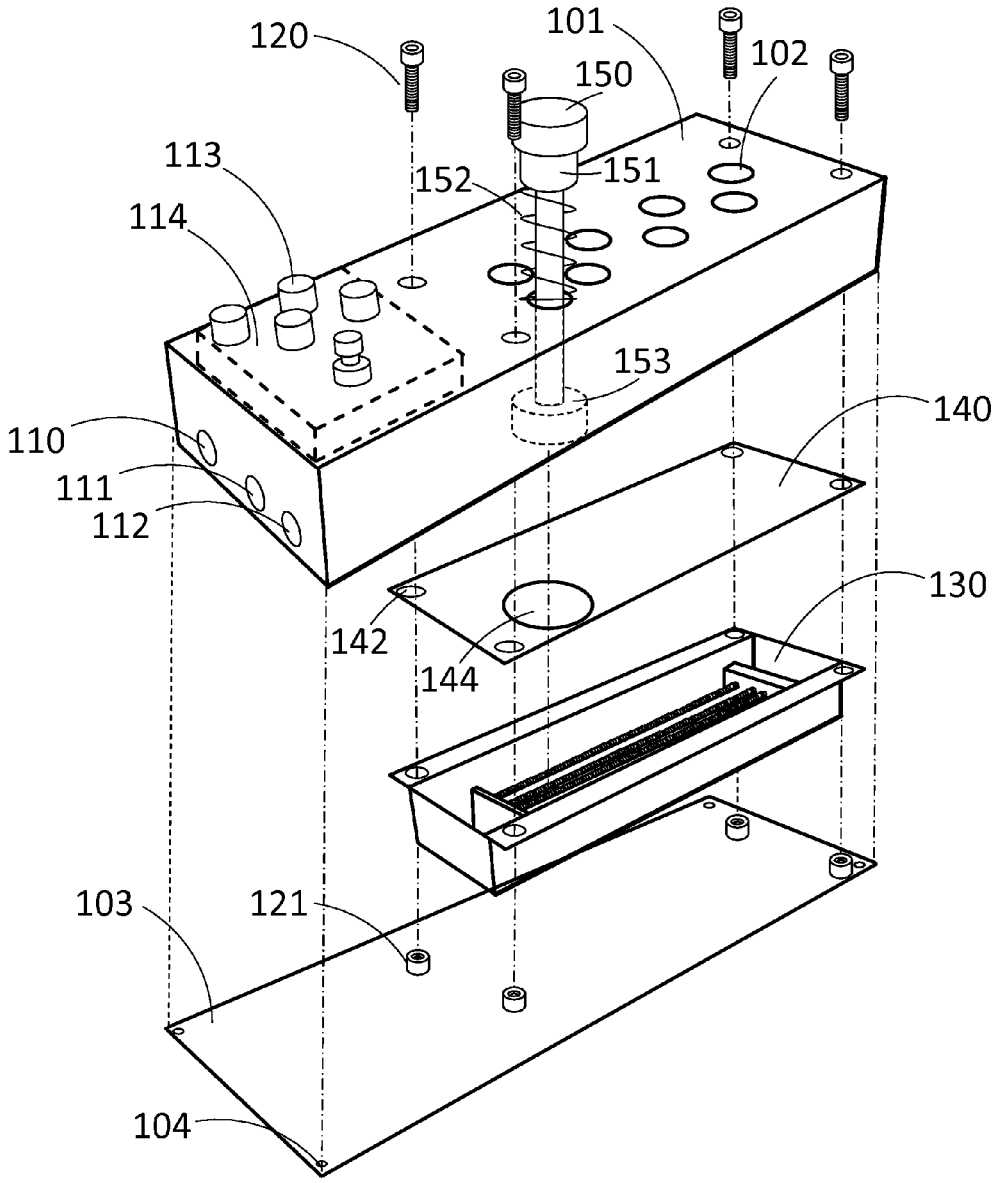
FIG. 7 shows an exploded view of another embodiment for incorporating a mechanical actuator to mechanically actuate a system within the enclosure.

FIG. 7 shows an embodiment based on FIG. 1 but with the addition of a mechanical actuator or plunger 150 of any shape or size attached to enclosure 101 that can move freely through the enclosure. The mechanical actuator can be made of any material such as metal, plastic, rubber etc and may be flexible along a portion or entirety of its length. Mechanical actuator 150 has an optional movable depth adjustor 151 which can be slid or screwed up or down the actuator to control the final depth the actuator will achieve when pushed down. Depth adjuster 151 can be fixed in place at the desired height with a set screw, threads on the shaft of the actuator or permanently with adhesive. Spring 152 is used to return the mechanical actuator to the up position after pressure has been released but it can be any flexible material. The spring can have any spring or tension constant but it expected that it will facilitate use by the operator. Spring 152 is shown on the top side of enclosure 101 but can also be on the bottom to either push the mechanical actuator out or pull it in. At the bottom of the mechanical actuator, tip 153 can be any shape, size or material based on the desired mode of operation such as a soft material to dampen an inside component, a hard surface to cause vibrations or blunt force, a pointed shape so that minimum surface area is used, etc. In an embodiment, clear material 140 is shown with an additional opening 144 which could be added if necessary to allow access to the device below. In an embodiment, the mechanical actuator assembly could be used to stop the vibrations of a reverb tank or to cause the reverb tank to sustain a force which will cause a change in the sound it produces. This could be used to control the snapping or booming sound used by a musician playing surf music or any other form of music. The mechanical actuator could also be used to control a push button switch within the enclosure. A simple method of producing the mechanical actuator would be to use a bolt, a spring and two nuts such that the head of the bolt and one nut is on the topside and a second nut holds it together and applies force on the bottom side. Washers could be used if more surface area is needed for any part of the system. Other methods are expected such as one manufactured part, etc.

Figure 8:
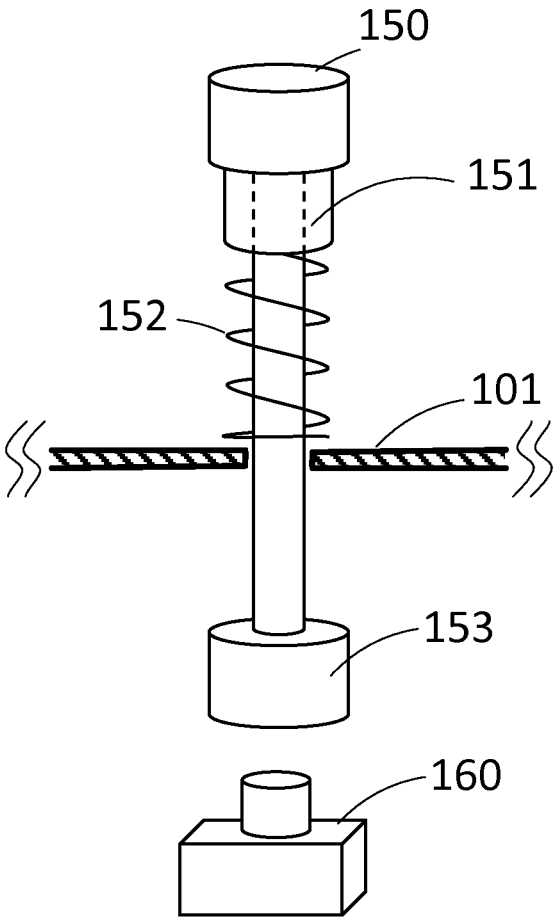
FIG. 8 shows a cross section of a mechanical actuator.

FIG. 8 shows a cross sectional view of a mechanical actuator 150 that can be attached through an opening in an enclosure 101 and used to apply pressure to a mechanical system within the enclosure such as a pushbutton switch 160, slide switch, reverb tank, spring, level or any moveable part. The mechanical actuator can be made of any material such as metal, plastic, rubber etc and may be flexible along a portion or entirety of its length. Mechanical actuator 150 has an optional movable depth adjustor 151 which can be slid or screwed up or down the actuator to control the final depth the actuator will achieve when pushed down. Optional depth adjuster 151 can be fixed in place at the desired height with a set screw, threads on the shaft of the actuator or permanently with adhesive. A spring 152 is used to return the mechanical actuator to the up position after pressure has been released. The spring can have any spring or tension constant but it expected that it will facilitate use by the operator. Spring 152 is shown on the top side of enclosure 101 but can also be on the bottom to either push the mechanical actuator out or pull it in. At the bottom of the mechanical actuator, a tip 153 can be any shape, size or material based on the desired mode of operation such as a soft material to dampen an inside component, a hard surface to cause vibrations or blunt force, a pointed shape so that minimum surface area is used, etc. The mechanical actuator assembly could be used to stop the vibrations of a reverb tank or to cause the reverb tank to sustain a force which will cause a change in the sound it produces. This could be used to control the snapping or booming sound used by a musician playing surf music or any other form of music. The mechanical actuator could also be used to control a push button switch within the enclosure. A simple method of producing the mechanical actuator would be to use a bolt, a spring and two nuts such that the head of the bolt and one nut is on the topside and a second nut holds it together and applies force on the bottom side. Washers could be used if more surface area is needed for any part of the system.

Figure 9:
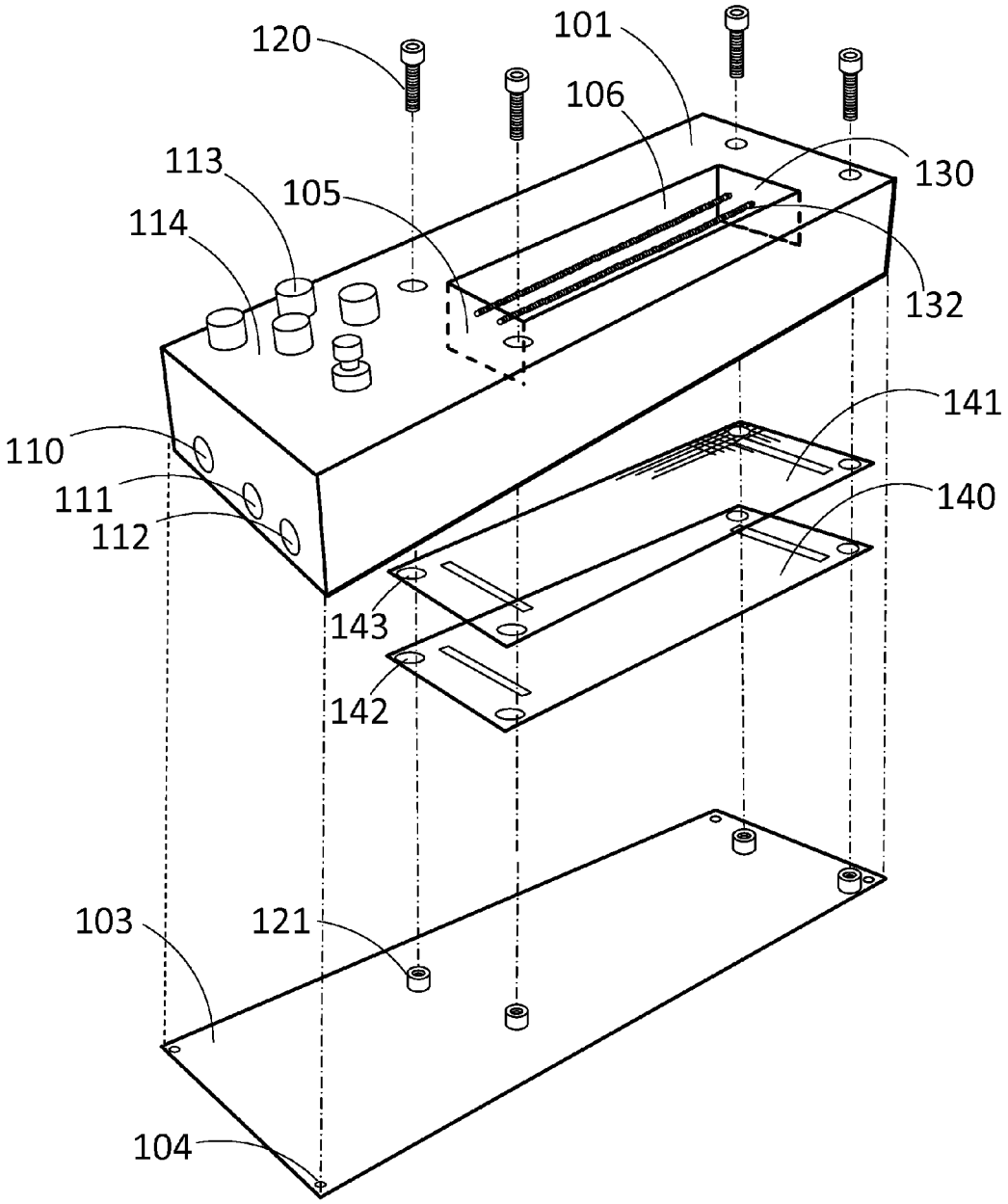
FIG. 9 shows an exploded view of another embodiment where the mechanical effect is built into the enclosure.

FIG. 9 shows an embodiment where an enclosure 101 has been shaped so that a flap or support 105 can be used to fix an effect producing apparatus directly to the enclosure in proximity to an opening 106 which allows the operator to view within. One method would be to use a portion of the material cut away for a window 106 and bend it down into the enclosure to form the support 105. The effect producing apparatus could be a chassis, reverb tank, mechanical system, spring 132 or any combination of springs, electrical circuit, etc. within the enclosure that can be viewed by the operator. Optional clear material 140 and optional screen 141 may need to be shaped so that they can be placed around supports 105 and fit flush with the enclosure.

Figure 10:
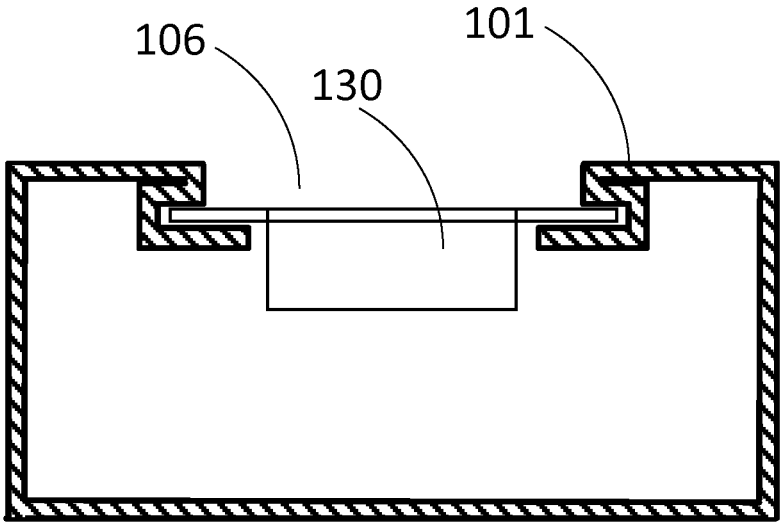
FIG. 10 shows a cross section of another embodiment where the enclosure is shaped to support a chassis.

FIG. 10 shows a cross section of an embodiment of an enclosure 101 where it is fabricated so that a slot is formed to allow for support of the effect producing apparatus 130 around the edges of an opening 106 used to view the effect producing apparatus. Effect producing apparatus 130 could be a chassis, reverb tank, mechanical system, electrical circuit, etc. within the enclosure that can be viewed through window 106 by the operator. The window may be covered by a clear protective material or screen.

Figure 11:
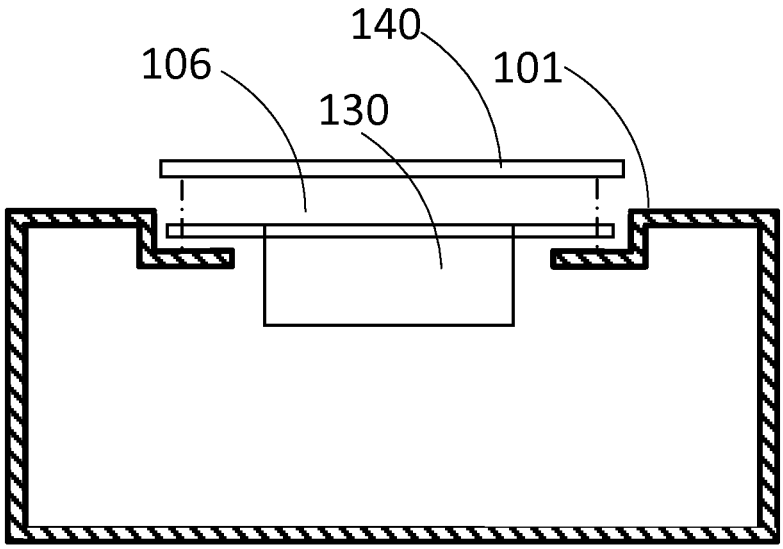
FIG. 11 shows a cross section of another embodiment where the enclosure is shaped to support a chassis.

FIG. 11 shows a cross section of another embodiment of the enclosure 101 where it is fabricated so that a recess is formed to allow for support of the effect producing apparatus 130. The effect producing apparatus 130 could be a chassis, reverb tank, mechanical system, electrical circuit, etc. within the enclosure that can be viewed through the window 106 by the operator. An optional clear protective material 140 can be fit over the window 106.

Figure 12:
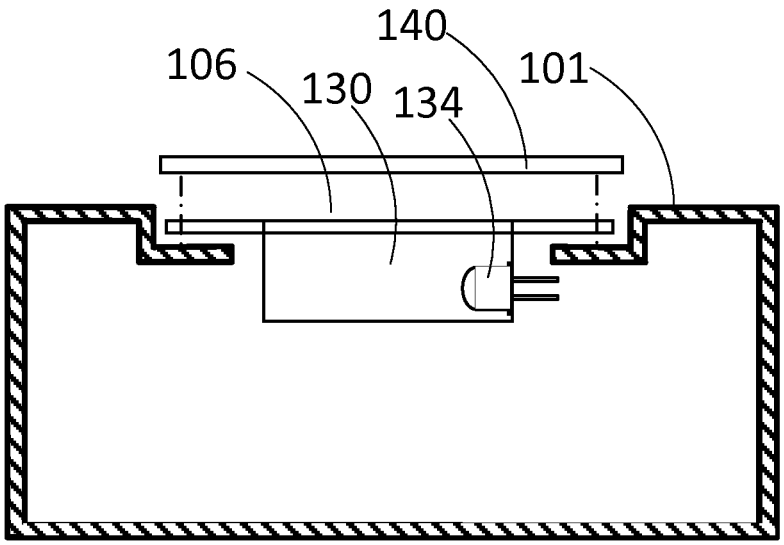
FIG. 12 shows a cross section of another embodiment where a light is incorporated into a chassis.

FIG. 12 shows a cross section of another embodiment of an enclosure 101 where a light 134 such as a light bulb or LED is inserted into and held in place by an effect producing apparatus 130. The light either indicates the operation of the pedal or is for decorative purposes and can be seen through window 106. The shape or cross section of enclosure 101 does not matter. The light illuminates effect producing apparatus 130 so that the operator can view it more easily. The effect producing apparatus 130 could be a chassis, reverb tank, mechanical system, electrical circuit, etc. within the enclosure.

Figure 13:
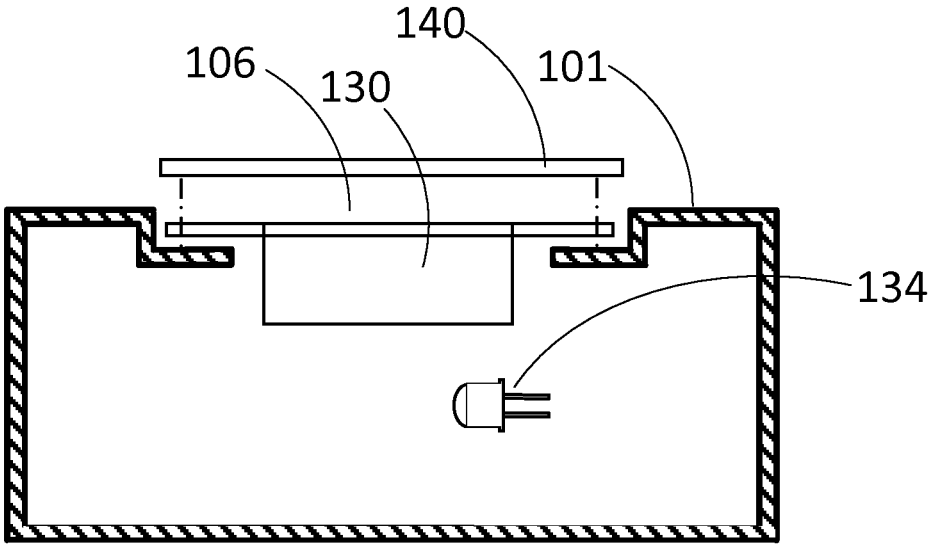
FIG. 13 shows a cross section of another embodiment where a light is incorporated into the enclosure.

FIG. 13 shows a cross section of another embodiment of an enclosure 101 where a light 134 such as a light bulb or LED is inserted into the enclosure. Light 134 either indicates the operation of the pedal or is for decorative purposes and can be seen through window 106. The shape or cross section of enclosure 101 does not matter. The light illuminates the effect producing apparatus 130 so that the operator can view it more easily. The effect producing apparatus 130 could be a chassis, reverb tank, mechanical system, electrical circuit, etc. within the enclosure. The light can be held in place inside the enclosure through several methods including wire, pcb board, screw, bolt, adhesive, support attached to the enclosure etc.

From the description of the enclosure above, a number of advantages of one or more aspects are that a) The operator is now able to view the effect producing apparatus within the enclosure
b) Electromagnetic interference can be reduced even though there are openings to see the effect producing apparatus.
c) Visual inspection of the effect producing apparatus is easier due to the ability of light to enter from outside or from a light within the enclosure.
d) The operator is now able to view other light emitting components within the enclosure that indicate the status of the effect producing apparatus
e) A light to indicate operational information is easier to mount because it can be mounted within to a PCB board and seen from the outside.
f) Sensitive components such as electrical or mechanical are protected during use and transport in a rigid enclosure.
g) The operator can tell if the unit is On or Off from the light indicator within the enclosure.
h) Direct connection to the effect producing apparatus within can be made from the outside.
i) Pass-throughs are provided for light, acoustics and mechanical actuation.
j) Interactions with mechanical systems within an enclosure using a mechanical actuator plunger are enabled.
k) An easier method of attaching the effect producing apparatus to an enclosure.
l) It eliminates the need for a separate chassis for a mechanical effect and both the electrical and mechanical parts can be attached to one enclosure.
m) Allows heat dissipation by allowing air to pass in and out of the unit.

CONCLUSION, RAMIFICATIONS AND SCOPE

Accordingly, the reader will see that an audio effect unit with an enclosure with window can be used to house and protect an audio effect producing apparatus while enabling viewing of the parts within. An operator can easily use the effect producing apparatus within and it will be protected both mechanically and electrically. Furthermore, it has the additional advantages that:

It provides a strong, protective case, for an electrical effects producing apparatus
It permits a light to be housed within the effect unit so that the operator can see into the unit
It can be any shape or size depending on the effects producing apparatus or custom needs of the manufacturer
It provides a housing with supports for attaching parts that together work as an effect producing apparatus Although the description above contains many specificities, these should not be construed as limiting the scope of the emblements but as merely providing illustrations of some of the several embodiments. For example the enclosure can have any shape, the window(s) in the enclosure can have any shape and any effect producing apparatus can be housed within or attached to the enclosure.

Thus the scope of the embodiments should be determined by the appended claims and their legal equivalents, rather than by the examples given.

What is claimed is:

1. An audio effect unit comprising:
a. a rigid and electromagnetically shielded enclosure;
b. at least one substantially vacant opening in said enclosure;
c. a transparent electrically conductive material;
d. an audio effect apparatus within said enclosure;
e. wherein said opening in said enclosure is electromagnetically shielded by said transparent electrically conductive material and approximately aligned to said audio effect apparatus within said enclosure, whereby an operator can more easily view said audio effect apparatus within said enclosure.

2. The audio effect unit of claim 1, wherein said opening is sufficiently small to block unwanted electromagnetic signals.

3. The audio effect unit of claim 1, further including a light contained within said enclosure.

4. The audio effect unit of claim 1, wherein said audio effect apparatus is a reverb tank.

5. The audio effect unit of claim 1, wherein said audio effect apparatus is an electrical circuit board assembly.

6. The audio effect unit of claim 1, wherein said enclosure is comprised of two substantially c-shaped pieces.

7. The audio effect unit of claim 1, wherein at least one edge of said opening is shaped as a fitting to hold said audio effect apparatus.

8. The audio effect unit of claim 1, wherein said opening is shaped as a fitting to hold said transparent electrically conductive material.

9. A method of manufacturing an audio effect unit to contain an audio effect apparatus, comprising:
a. providing a rigid and electromagnetically shielded enclosure having at least one substantially vacant opening;
b. shielding said at least one substantially vacant opening with a transparent electrically conductive material;
c. providing an audio effect apparatus within said enclosure;
d. aligning said audio effect apparatus within said enclosure with said vacant opening, whereby an operator can more easily view said audio effect apparatus within said enclosure through said transparent electrically conductive material.

10. The method of claim 9, further comprising: providing a light within said enclosure so that said audio effect apparatus is more easily visible.

11. The method of claim 9, further comprising: shaping said vacant opening so that said audio effects apparatus may be inserted into formed recesses or slots at the edges of said opening.

12. The method of claim 9, further comprising: shaping said opening so that said transparent electrically conductive material may be inserted into formed recesses or slots at the edges of said opening.

13. An audio effect unit comprising:
a. a rigid enclosure;
b. at least one substantially vacant opening in said enclosure;
c. a mechanical reverb tank;

d. said opening in said rigid enclosure is approximately aligned to said mechanical reverb tank contained within said enclosure;

whereby an operator can more easily view said reverb tank within said enclosure.

14. The audio effect unit of claim 13, further including a light contained within said enclosure.

15. The audio effect unit of claim 13, further including a transparent material shielding said opening.

16. The audio effect unit of claim 15, wherein said transparent material is a transparent electrically conductive material.

* * * * *